US007021098B2

(12) United States Patent
Griskiewitz et al.

(10) Patent No.: US 7,021,098 B2
(45) Date of Patent: Apr. 4, 2006

(54) METHOD AND DEVICE FOR CREATING A HOLE ON THE OUTER CIRCUMFERENCE OF A HOLLOW PROFILE

(75) Inventors: Thomas Griskiewitz, Stelle (DE); Thomas Lohse, Mechtersen (DE); Stefan Schwarz, Luenen (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 10/873,634

(22) Filed: Jun. 23, 2004

(65) Prior Publication Data

US 2005/0016237 A1 Jan. 27, 2005

(30) Foreign Application Priority Data

Jun. 25, 2003 (DE) ..... 103 28 452

(51) Int. Cl.
*B21D 28/28* (2006.01)
*B21D 26/02* (2006.01)

(52) U.S. Cl. ..... 72/55; 72/56; 83/54; 83/53

(58) Field of Classification Search ..... 72/55, 72/56; 29/421.1; 83/53, 54

See application file for complete search history.

(56) References Cited

U.S. PATENT DOCUMENTS 5,398,533 A 3/1995 Shimanovski et al.
5,816,089 A * 10/1998 Marando ..... 72/55
6,341,514 B1 * 1/2002 Engel et al. ..... 72/55
6,439,018 B1 * 8/2002 Hellgren et al. ..... 72/55

FOREIGN PATENT DOCUMENTS

DE 19752171 A1 6/1998

* cited by examiner

*Primary Examiner*—David B. Jones
(74) *Attorney, Agent, or Firm*—Crowell & Moring LLP

(57) ABSTRACT

In a method and a device for creating a hole on the outer circumference of a hollow profile which is circumferentially closed and under an internal high pressure, before hole-punching, a punch which is integrated in the internal high pressure forming mold such that it can be guided butts against the location of the hole to be created. When it leaves its position of abutment, the punch creates a punched slug there alongside the hole. To make it possible for holes to be punched at virtually any desired location in hollow profiles in the internal high-pressure forming mold in a simple way, it is proposed that the hole-punching takes place by the punch being moved in the guiding bore of the forming mold by the internal high pressure acting together with a driving element, the body axis of which lies approximately at 90° in relation to the hole punch axis and which for its part is driven in a rotary manner and/or translatory manner in the axial direction. The punch is acted on on the side facing away from the impression by driving contours of the driving element.

20 Claims, 5 Drawing Sheets

METHOD AND DEVICE FOR CREATING A HOLE ON THE OUTER CIRCUMFERENCE OF A HOLLOW PROFILE

BACKGROUND AND SUMMARY OF THE INVENTION

This application claims the priority of German application 103 28 452.4, filed Jun. 25, 2003, This invention relates to a method for creating a hole on the outer circumference of a hollow profile which is circumferentially closed and under an internal high pressure, and to a device for carrying out such a method.

A method of this general type and a device of this general type are known from German publication DE 197 52 171 A1. In the method described in this publication, a tubular hollow profile is placed into an internal high-pressure forming mold, which is subsequently closed. An internal high pressure is then produced inside the hollow profile and makes the hollow profile expand until it comes to bear with its walls against the impression of the internal high-pressure forming mold. A bore in which a hole punch is guided branches off from the impression. After the expansion of the hollow profile, the end face of the hole punch facing the impression butts against the outer side of said hollow profile. To create a hole on the outer circumference of the hollow profile, the hole punch is driven by a driving element on the side facing away from the impression. This takes place by the hole punch penetrating into the hollow profile and thereby cutting out a punched slug. Since the lateral sealing of the hole punch in the forming mold and the internal high pressure are maintained, the punched slug remains attached to the end face of the hole punch. The hole punch together with the punched slug is thereafter retracted into the guiding bore of the hole punch. As a result, a hole-shaped opening is formed in the wall of the hollow profile. Generally, the hole punch is driven by a hydraulic cylinder as the driving element, which is arranged such that it is colinear in relation to the center axis of the guiding bore of the hole punch on the internal high-pressure forming mold. Such hydraulic cylinders have large volumes and require relatively large installation spaces. Consequently, the use of such hydraulic cylinders in connection with confined installation spaces and regions of the hollow profile within the internal high-pressure forming mold to which access is difficult is virtually impossible. As a result, the versatility of hole creation in the internal high-pressure forming mold is restricted considerably. Disadvantageously, therefore, the hollow profile cannot be punched as desired, and it is inconveniently necessary to forgo the internal high-pressure forming mold in favor of other conventional molds to make it possible for the holes to be produced. On the other hand, when punching holes with conventional molds, without the presence of a fluidic high pressure as a supporting pressure, the hollow profile contour loses its dimensional stability due to indentations and the like.

One object of this invention is the object of developing a method of the type mentioned to the extent that it is made possible for holes to be punched at virtually any desired location in hollow profiles in the internal high-pressure forming mold in a simple way.

This object is achieved according to an inventive method by way of a punch which is integrated in an internal high-pressure forming mold such that it can be guided, which, when it leaves its position of abutment, creates a punched slug there alongside the hole, and which is acted on by a driving element. The driving element has a body axis which lies approximately at 90° in relation to a hole punch axis, and is driven in at least one of a rotary manner and a translatory manner in the axial direction, against a location of the hole to be created. Hole-punching results from moving the punch in a guiding bore of the forming mold by way of the internal high pressure acting together with the driving element. The object mentioned is also achieved according to an inventive device by way of a punch, which is guided in an internal high-pressure forming mold and which, before hole-punching, butts against the location of the hole to be created, and a driving element for driving the punch. A body axis of the driving element is arranged approximately at 90° in relation to the hole punch axis, and the driving element is driven in at least one of a rotary manner and a translatory manner in the axial direction. The driving element acts with a driving contour on a punch head arranged on a side of the punch facing away from a mold impression acting together with an internal high pressure driving the punch outward.

On account of the special arrangement of the driving element axis, which extends approximately at 90° in relation to the hole punch axis, in combination with drive contours which are arranged on the driving element and act on the punch head of the hole punch, the movement of the drive of the driving element which causes the driving of the hole punch is deflected, whereby the two drives lead to directions of movement of the driving element and the hole punch that are different from each other. This allows the drive of the hole punch to be led out from the forming mold in a space-saving way, making it possible to dispense with the high-volume colinear arrangement of the drive for the hole punch. The drive for the driving element, which may for example also be a servo motor, can then be arranged on the forming mold in regions which are easily accessible and where no complications of a structural or design-related nature with already existing mold parts of the forming mold occur. The hole-punching operation is consequently virtually independent of the installed location of the drive for the hole punch or of the installed location of the driving element, so that hole-punching is possible at virtually any desired location of the hollow profile. Furthermore, the invention even makes it possible, in a way which saves installation space, to accommodate the driving element within the forming mold; suitable bores or clearances have to be provided for this purpose. Furthermore, it is no longer necessary to carry out an adaptation of the control of the hydraulics and the electrics of the hydraulic cylinder, as previously required for setting the hole-punching operation, which in the past involved considerable expenditure in terms of apparatus. This setting is now accomplished in a simple way by a suitable design of the drive contours of the driving element.

Expedient refinements of the invention will be apparent from the dependent claims; otherwise, the invention is explained in more detail below on the basis of several exemplary embodiments represented in the drawings.

DETAILED DESCRIPTION OF THE INVENTION

Figure 1:
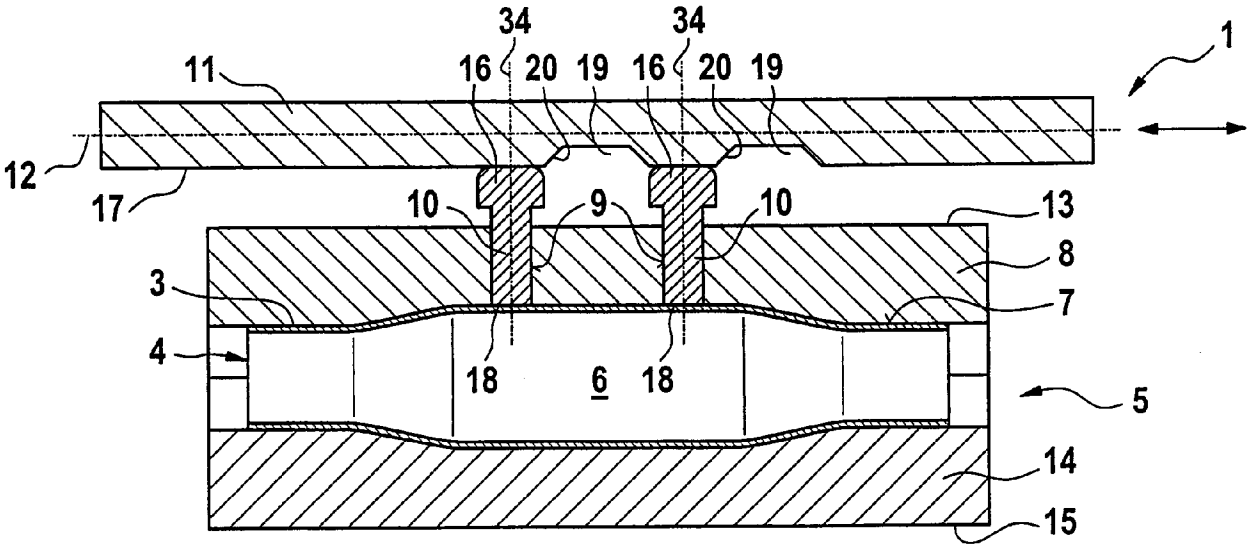
FIG. 1 shows a device according to the invention in a longitudinal section, with a slide as a driving element for a hole-punching operation from the inside outward, in the not-in-use position of the punches.

A device 1 for creating a hole 2 on the outer circumference 3 of a circumferentially closed hollow profile 4, which has been placed in an internal high-pressure forming mold 5, is represented in FIG. 1. The hollow profile 4 is furthermore sealed by axial rams, not shown here. A fluid is introduced into the interior 6 of the hollow profile 4 via the axial rams and subjected to high pressure. As a result, the hollow profile 4 is correspondingly made to expand, until it comes to bear against the impression 7 of the internal high-pressure forming mold 5. Formed in the upper part 8 of the forming mold 5 are two guiding bores 9, in each of which a hole punch 10 is arranged such that it can be guided. Apart from the hole punch 10, the device 1 comprises an elongate slide 11, which can be moved back and forth as indicated by the double-headed arrow. In this exemplary embodiment, the slide 11 is arranged above the upper part 8 of the forming mold 5 and is formed such that it is substantially flat on both sides. The body axis 12 of the slide 11, which forms the driving element for driving the hole punch 10, lies approximately at 90° in relation to the hole punch axis 34, preferably parallel to the upper side 13 of the upper part 8 of the forming mold 5. When the hole punches 10 are arranged in the lower part 14 of the forming mold 5, the body axis 12 of the slide 11 preferably lies parallel to the underside 15 of the lower part 14. In the not-in-use position of the hole punches 10 shown in FIG. 1, the punch head 16 arranged on the side of the punch 10 facing away from the mold impression 7 is supported on the underside 17 of the slide 11. The end faces 18 of the hole punches 10 facing toward the impression 7 finish flush with the openings of the guiding bores 9. Directly next to the supporting position of each punch head 16 of the hole punches 10 on the underside 17 of the slide 11, a hollow 19 is respectively formed in the underside 17 of the slide 11. A 19 is assigned to each individual hole punch 10. The flanks of the hollow 19 are formed by wedge surfaces 20, and the wedge surfaces form the driving contour for the hole punch 10. If the slide 11 is then displaced in a translatory manner along its body axis 12, the hole punch 10, driven by the internal high pressure, enters the hollow 19. The planar support against the slide 11 transforms into the support against the wedge surface 20 of the hollow 19 (see FIG. 2). As the hole punch 10 enters the hollow 19, its end face 18 leaves the position of abutment against the hollow profile 4. As this happens, part of the guiding bore 9 is cleared. Since the support of the hollow profile 4 against the end face 18 of the hole punch 10 is now absent, hollow profile material is forced by the internal high pressure into the guiding bore 9 at this location. If the speed at which the hole punch 10 enters the hollow 19 is great enough, a punched slug 21 is torn out of the hollow profile 4 into the guiding bore 9. This creates a hole 2 on the outer circumference 3 of the hollow profile 4. If the hole punch 10 is adequately sealed in the guiding bore 9 with respect to the internal high-pressure forming mold 5, the punched slug 21 is pressed against the end face 18 of the hole punch 10. At the same time, however, the punched slug 21 becomes lodged in the guiding bore 19, so that after completion of the hole-punching operation and release of the fluid pressure as well as removal of the hollow profile 4 with the finished punched holes, the punched slug 21 can be removed in an overseen manner from the forming mold 5 without falling into it. The removal may be performed in a simple way by advancing the hole punch 10, whereby the punched slug 21 is released from the guiding bore 9. The quality of the cut, i.e. the quality of the hole, is determined by the speed at which the hole punch 10 enters the hollow 19, it being necessary for the speed to be sufficiently great. This speed is in turn dependent on the speed at which the slide travels and on the setting angle of the wedge surface 20. The speed of entry becomes greater as the speed at which the slide 11 travels increases and as the setting angle of the wedge surface 20 becomes greater. By careful machining of the wedge surface 20, the speed of entry can be set very exactly. It is quite possible in this respect for the wedge surface 20 also to be formed such that it is rounded. Furthermore, it is conceivable for the wedge surface 20 also to be formed in a stepped manner with sloping offsets. To avoid increased wear of the punch head 16 and of the slide 11 after repeated hole-punching operations, however, it is required to make the setting angle of the wedge surface 20 suitably shallow. This allows the punch 10 to be guided gently along the wedge surface 20 into the hollow 19. Advantageous effects on the profile of the hole, and consequently the quality of the hole-punching operation, are also provided if the opening rim 22 of the guiding bore 9 is formed as a cutting edge. This is because a clean separation of the punched slug 21 from the hollow profile 4 is achieved. Otherwise, an additional reduction of the wear on the punch head 16 and on the slide 11 can be achieved by coating the punch head 16 and/or the slide 11 with a wear-protecting layer and/or an anti-friction layer. After completion of the hole-punching operation from the inside outward, the fluid pressure is released, after which the punch 10 can be advanced in a simple way by movement of the slide 11 in the opposite direction, without any counter-pressure, into its not-in-use position.

Figure 3:
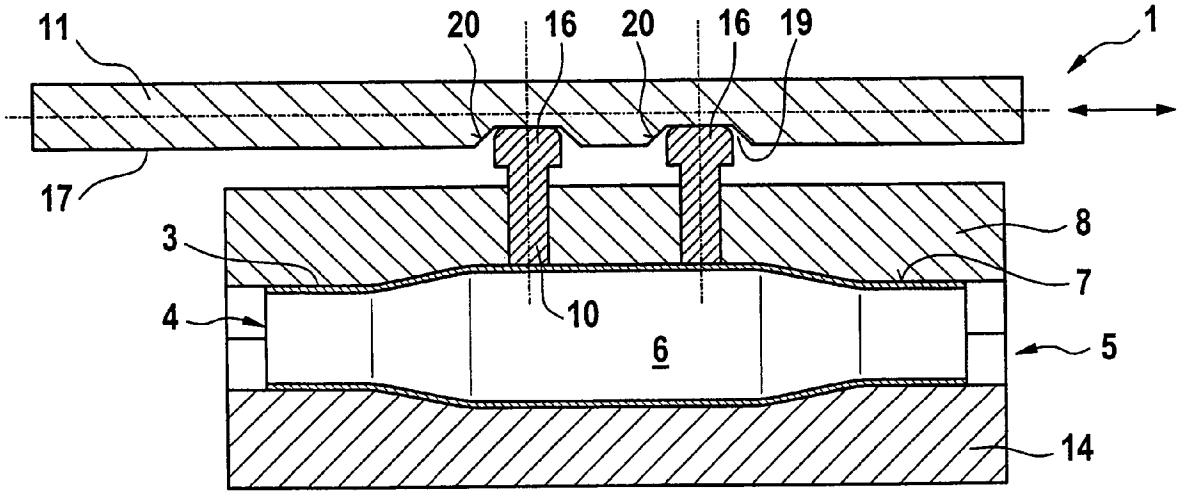
FIG. 3 shows a device according to the invention in a longitudinal section, in the not-in-use position of the hole punches, for punching from the outside inward.
Figure 4:
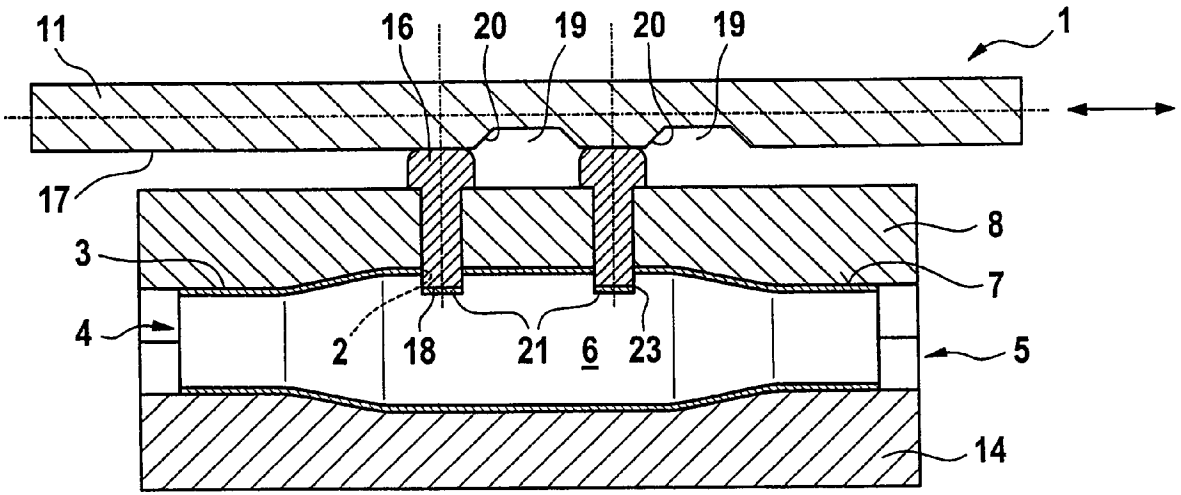
FIG. 4 shows the device of FIG. 3 in the in-use position of the hole punches.

A variant of the device 1 according to the invention is represented in FIGS. 3 and 4, a difference from the above exemplary embodiment being that the hole punches 10 are located within the hollow 19 of the slide 11 in their not-in-use position. For this purpose, the slide 11 is arranged at a smaller distance from the upper part 8 of the forming mold 5. If the slide 11 is then advanced, the respective punch head 16 slides along the wedge surface 20, whereby the pushing force via the slide 11 is deflected in a simple way and, as a result, the hole punch 10 is pressed into the hollow profile 4, toward the impression 7 of the forming mold 5, counter to the direction in which the internal high pressure is acting. Once the punch head 16 butts against the planar underside 17 of the slide 11, the hole punch 10 enters the interior 6 of the forming mold 4, the hole punch 10 having cut out the punched slug 21 from the outer circumference 3 of the hollow profile 4 with its cutting edge 23. In this cutting operation, the internal high pressure supports the hollow profile 4 against the penetrating hole punch 10 in such a way that no indentations are produced on the hollow profile 4, and consequently the dimensional stability of the circumferential contour of the hollow profile 4 remains ensured. Furthermore, a high-precision hole profile is obtained from this cutting operation. If there is adequate sealing of the hole punches 10 with respect to the hollow profile 4, no pressure drop occurs in the hollow profile 4 during the cutting operation, so that the punched slugs 21 remain pressed against the end face 18 of the hole punches 10 and, with the internal high pressure applied, the hole punches 10 can be moved back together with the punched slug 21 without the punched slug 21 being able to detach itself from the end face 18 of the hole punch 10. After the retracting movement of the slide 11 necessary for this, the hole punch 10 has again entered the hollow 19 of the slide 11 and the punched slug 21 is lodged in the hole 2 created. This allows the hollow profile 4 to be removed together with the punched slug 21 in a simple way from the impression 7 of the forming mold 5 after forming and hole-punching have taken place, without the punched slug 21 thereby falling into the impression 7 of the mold 5 and then having to be removed from the latter in a very laborious way. The punched slug 21 lodged in the hollow profile 4 can then be released from hollow profile 4 by suitable means outside the internal high-pressure forming mold 5. Suckers which remove the punched slug 21 from the hollow profile 4 with little effort, for example, can conceivably be used. The hole-punching from the outside inward described in this variant of the invention can also be combined with the first exemplary embodiment of hole-punching from the inside outward. A change in the type of hole is brought about by lifting or lowering the slide 11. Of course, during the change mentioned, the slide 11 must thereby also be displaced in the direction of the body axis, so that the hole punch 10 can respectively assume its not-in-use position. With this combination of hole-punching operations, improved release of the punched slug 21 from the hollow profile 4 can take place, since the punch 10 is initially pressed onto the hollow profile 4 in accordance with the hole-punching operation from the outside inward. As a difference from the described cutting out of the punched slug 21 in the case of the hole-punching operation from the outside inward, the slide 11 is moved away from the upper part 8 of the forming mold 5 to the extent that the hole punch 10 can only begin cutting into the hollow profile 4 or leave an impression of the contour of its end face 18. This creates a predetermined breaking location, which facilitates the subsequent hole-punching operation from the inside outward and improves still further the quality of the hole profile. As in the first exemplary embodiment but more easily, the punched slug 21 can then be pressed into the hole 2, again with a lodging effect, by advancement of the punch 10. The advantage of the punched slug 21 becoming lodged has already been referred to in the second exemplary embodiment. However, to ensure unhindered later removal of the hollow profile 4 from the forming mold 5, the punched slug 21 should finish flush with the rim of the hole.

Figure 2:
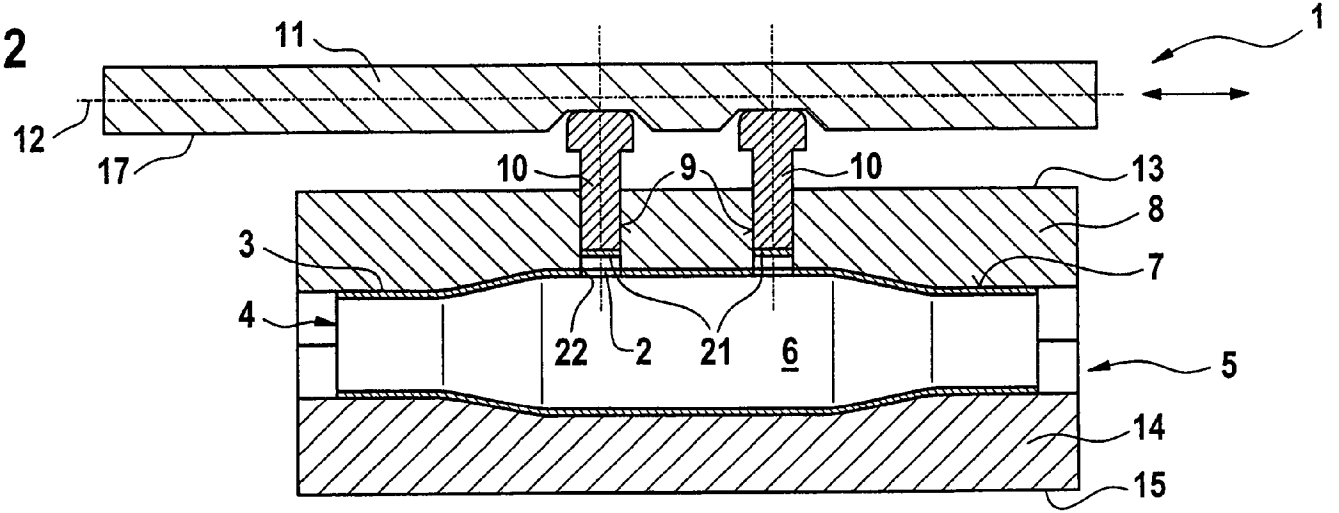
FIG. 2 shows the device of FIG. 1 in the in-use position of the hole punches.
Figure 5B:
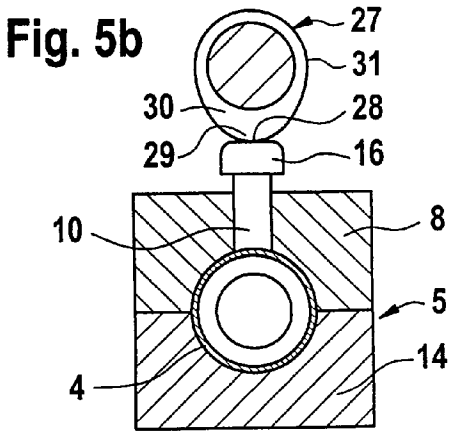
FIG. 5*b* shows the device of FIG. 5*a* in a cross-sectional view.
Figure 6B:
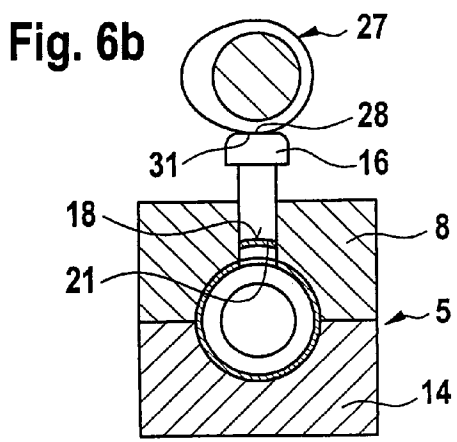
FIG. 6*b* shows the device of FIG. 6*a* in a cross-sectional view.
Figure 5A:
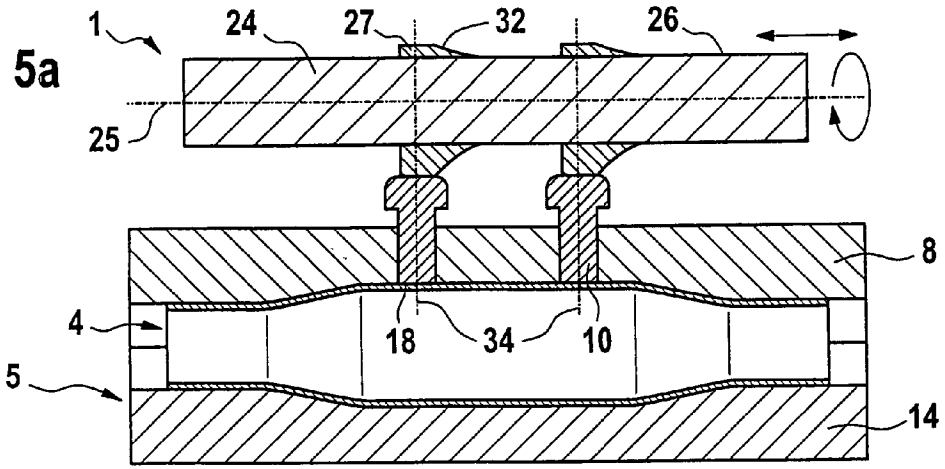
FIG. 5*a* shows a device according to the invention with a driving element which is formed as a camshaft, in the not-in-use position of the hole punches, for a hole-punching operation from the inside outward.
Figure 6A:
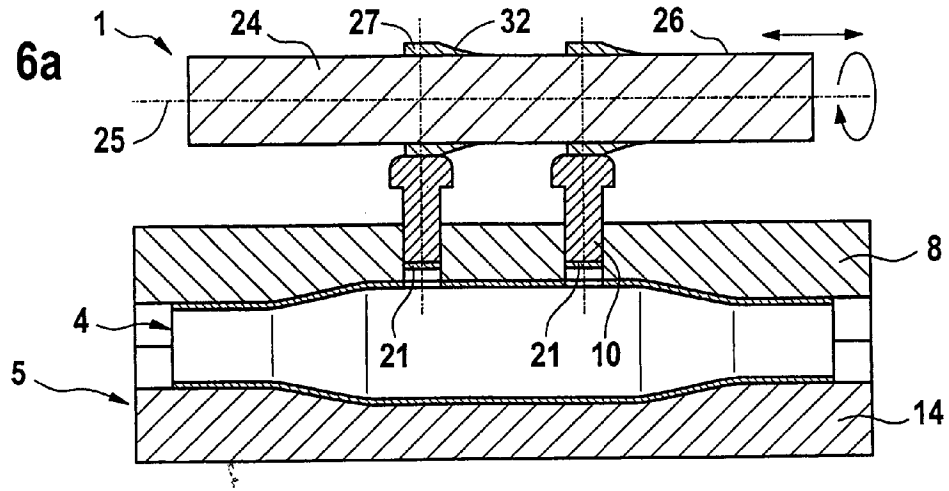
FIG. 6*a* shows the device of FIG. 5*a* in the in-use position of the hole punches.

FIG. 5 and FIG. 6 together show a further variant with respect to the previous exemplary embodiments. In this case, the hole-punching operation is the same as that which can be seen in FIG. 1 and FIG. 2, that is hole-punching from the inside outward. However, instead of the slide 11, arranged at a distance from the upper part 8 of the forming mold 5 is a shaft 24, the body axis 25 of which likewise lies at 90° in relation to the hole punch axis 34 and parallel to the upper part 8 of the forming mold 5. The shaft 24 can be driven by a motor and has on the circumference 26, in the region of the hole punches 10, a driving contour comprising non-rotationally-symmetrical surfaces. By means of the non-rotationally-symmetrical surfaces of the shaft 24, each of the punch heads 16 of the hole punches 10 is acted on to a greater or lesser extent according to the rotational angular position of the shaft 24. The rotationally movable shaft 24 may be cast or forged together with its driving contour. It is also conceivable in an advantageous way, for a lightweight construction of the device 1, to design the shaft 24 as a hollow shaft. The non-rotationally-symmetrical surfaces of the hollow shaft are formed here by a cam 27 (FIG. 5*b* and FIG. 6*b*), the internal high pressure in the hollow profile 4 pressing the hole punch 10 against the cam 27. In the not-in-use position of the hole punches 10, in which their end faces 18 finish flush with the opening rim 22 of the guiding bores 9, the upper sides 28 of the punch heads 16 is supported on the tip 29 of the cam lug 30. When there is a rotational movement of the shaft 24, the cam contour rolls on the upper side 28 of the punch head 16 and reaches the base circle 31 of the cam contour. The hole punch 10, which successively moves outward from its not-in-use position, is then in its end position again. The continuous rolling of the hole punch 10 on the cam contour means that virtually no wear occurs between these two elements supported on each other. On account of the receding of the hole punches 10 from the impression 7, the same hole-punching operation from the inside outward as in FIGS. 1 and 2 is obtained. On account of the arrangement of the described camshaft as a driving element, the hole-punching operation and the cycle time of the hole punch movement can be set particularly simply and precisely by a continuous rotational movement of the shaft 24. A connection of the shaft 24 to a suitable drive allows very high rotational speeds of the shaft 24, and consequently of the punch movement, to be achieved. The camshaft may otherwise be formed simply in production engineering terms in a built-up form, in that the shaft 24 is formed by a tube onto which the cam 27 is pushed as a separate component and joined to it. The joining may take place by making the shaft 24 expand by means of high internal fluidic pressure.

Figure 7A:
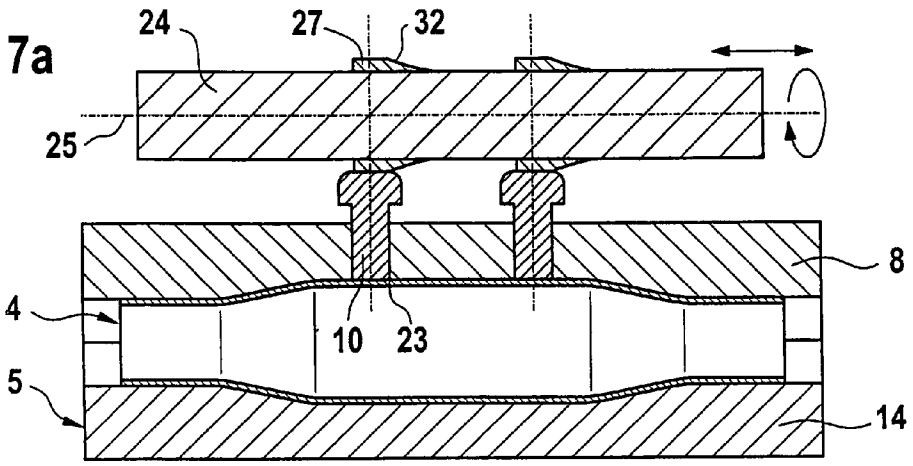
FIG. 7*a* shows a device according to the invention with a driving element formed as a camshaft, in the not-in-use position of the hole punches, for a hole-punching operation from the outside inward, in a longitudinal section.
Figure 7B:
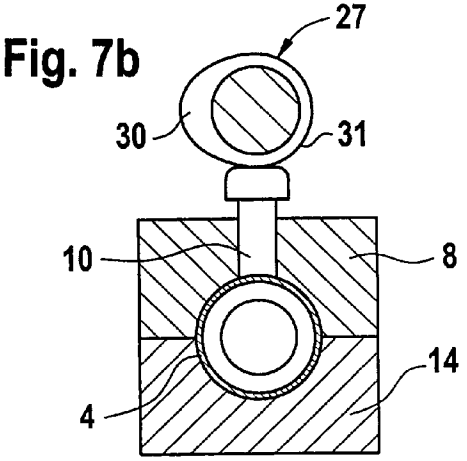
FIG. 7*b* shows the device of FIG. 7*a* in a cross-sectional view.
Figure 8A:
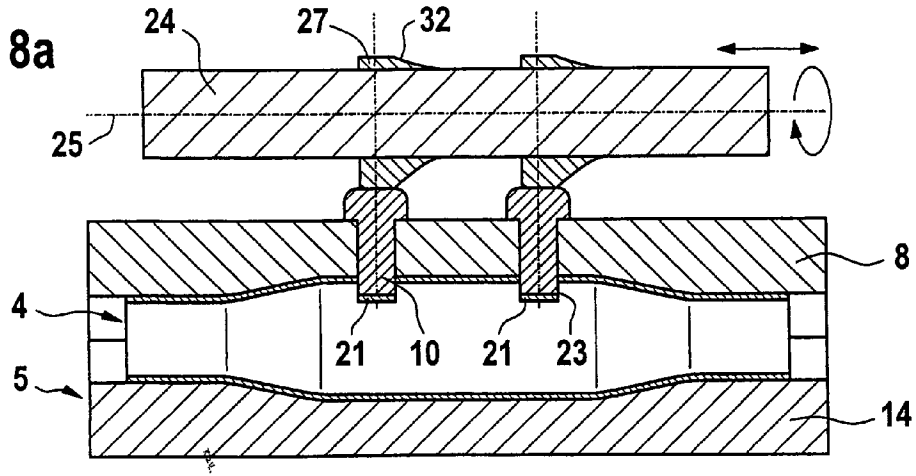
FIG. 8*a* shows the device of FIG. 7*a* in the in-use position of the hole punches.
Figure 8B:
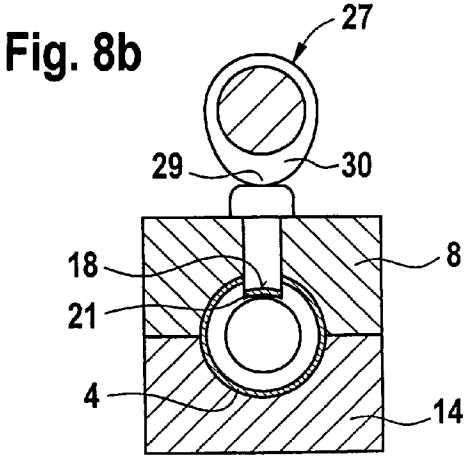
FIG. 8*b* shows the device of FIG. 8*a* in a cross-sectional view.

A further variant of the invention can be seen in FIGS. 7 and 8. The two figures are comparable in respect of the hole-punching operation with that of FIGS. 3 and 4; i.e., here, too, hole-punching is performed from the outside inward. In FIGS. 7*a* and 7*b*, the not-in-use position of the hole punches 10 is shown, the base circle 31 of the cam 27 resting against the upper side 28 of the punch head 16. For this purpose, the arrangement of the shaft 24 is brought closer to the upper part 8 of the forming mold 5 than is the case in FIG. 5 and FIG. 6. If the shaft 24 is then turned, the cam lug 30 actuates the hole punch 10, so that the latter is pressed into the circumferentially closed hollow profile 4 and the punched slug 21 is cut out by the cutting edge 23 of the punch 10. The punch 10 has completed the hole-punching operation when the tip 29 of the cam 27 comes to lie on the upper side 28 of the punch head 16. As represented in FIGS. 5*a*, 6*a*, 7*a* and 8*a*, the cam 27 may have a continuation 32 on the side. The continuation extends such that it becomes narrower in the axial direction of the shaft 24. The surface of the continuation 32 may be formed in a concave manner or else as a wedge surface.

In combination with the cam 27, this continuation 32 makes possible a hole-punching movement which results from the superposed movement of the rotation of the shaft 24 with a translatory movement of the shaft 24 along its body axis 25, which is indicated in the drawings by the arrows. This leads to an even faster hole-punching operation.

It is moreover conceivable in the case of all the exemplary embodiments described to allow the hole-punching operations also to take place during the expansion caused by the internal high pressure, if adequate sealing of the punches 10 with respect to the interior 6 of the hollow profile is guaranteed. This leads to a further reduction in the production time of the overall hollow profile 4, which here comprises the initial forming on the one hand and the hole punching on the other hand.

Figure 9A:
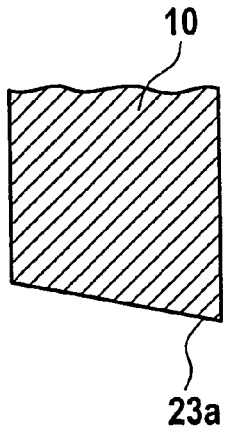
FIGS. 9*a–e* show ends of hole punches of various cutting geometries in longitudinal sections.
Figure 9B:
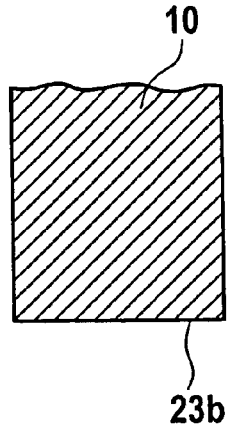
Figure 9C:
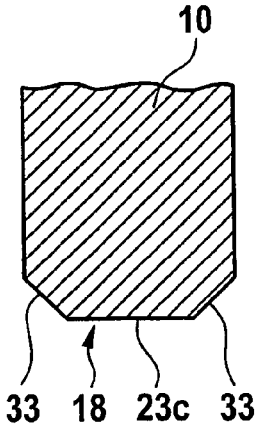
Figure 9D:
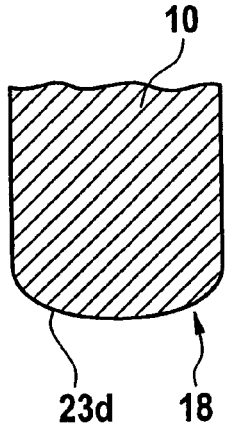
Figure 9E:
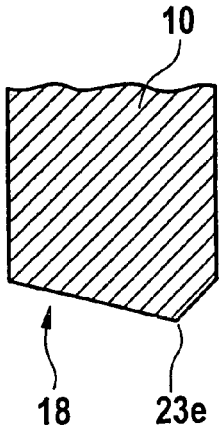

The hole profile of the hole 2 created can be configured virtually as desired by variation of the cutting geometry of the cutting edge 23 of the hole punch 10. A selection of cutting geometries is represented in FIGS. 9*a* to *e*. FIG. 9*a* shows an inclined cutting edge 23*a*, which is suitable for creating relatively large hole diameters, since the slope has the effect that the cut is in each case delayed in time and, as a result, a lower overall cutting force has to be exerted. FIG. 9*b* shows a cutting edge 23*b* of a shape based on the contour of the hollow profile 4, whereby the punching-out of holes 2 proceeds very quickly or abruptly on account of the hollow profile 4 being acted on by the entire cutting edge 23*b*. The contour of the end face 18 of the punch end of the hole punch 10 of FIG. 9*c* serves the purpose on the one hand of cutting out a hole 2 of small diameter, which is carried out by the central cutting edge 23*c*, and on the other hand of at the same time forcing the hollow profile material surrounding the hole 2 into the interior 6 of the hollow profile 4 to form a bush in the hollow profile 4, which takes place by the lateral slopes 33. A further possibility for forming the end of the punch is the convex formation of the end face 18 according to FIG. 9*d*. By means of the rounded contour 23*d* of the end face 18, it is possible to form indentations on the hollow profile 4 to produce predetermined breaking locations. The provision of a cutting edge 23*e* which runs transversely over the end face 18 of the hole punch 10, as can be seen in FIG. 9*e*, fulfills the purpose of creating a hole 2 when there is a lack of space during hole-punching. In this case, the punched slug 21 remains attached, and the punched slug 21 is divided into two and bent away to both sides during the cutting of the hollow profile 4.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

The invention claimed is:

1. A method for creating a hole at an outer circumference of a hollow profile which is circumferentially closed and under an internal high pressure, comprising:

driving a driving element having a body axis which lies approximately at 90° in relation to a hole punch axis in a rotary manner, guiding a punch, which is integrated in a guiding bore of an internal high-pressure forming mold, along the hole punch axis, and hole-punching upon moving the punch in the guiding bore, wherein the punch is acted on during its movement by a non-rotationally-symmetrical surface of the driving element.

2. The method as claimed in claim 1, wherein hole-punching takes place from inside outward by way of retracting movement of the punch with respect to the hollow profile.

3. The method as claimed in claim 1, wherein the hole-punching takes place from outside inward by way of advancing movement of the punch with respect to the hollow profile.

4. The method as claimed in claim 1, wherein the hollow profile is cut into by the punch at a location of a slug to be created, thereby forming a predetermined breaking location.

5. The method as claimed in claim 1, wherein, after its formation by the punch, a punched slug is pressed into the hole flush with a rim of the hole.

6. A method for creating a hole at an outer circumference of a hollow profile which is circumferentially closed and under an internal high pressure, comprising:

driving a driving element having a body axis which lies approximately at 90° in relation to a hole punch axis in at least one of a rotary manner and a translatory manner in a direction of the body axis, guiding a punch, which is integrated in a guiding bore of an internal high-pressure forming mold, along the hole punch axis, and hole-punching upon moving the punch in the guiding bore, wherein the hole-punching takes place from outside inward by way of advancing movement of the punch with respect to the hollow profile.

7. The method as claimed in claim 6, wherein the hollow profile is cut into by the punch at a location of a slug to be created, thereby forming a predetermined breaking location.

8. The method as claimed in claim 6, wherein, after its formation by the punch, a punched slug is pressed into the hole flush with a rim of the hole.

9. A method for creating a hole at an outer circumference of a hollow profile which is circumferentially closed and under an internal high pressure, comprising:

driving a driving element having a body axis which lies approximately at 90° in relation to a hole punch axis in at least one of a rotary manner and a translatory manner in a direction of the body axis, guiding a punch, which is integrated in a guiding bore of an internal high-pressure forming mold, alone the hole punch axis, and hole-punching upon moving the punch in the guiding bore, wherein, after its formation by the punch, a punched slug is pressed into the hole flush with a rim of the hole.

10. A method for creating a hole at an outer circumference of a hollow profile which is circumferentially closed and under an internal high pressure, comprising:

driving a driving element having a body axis which lies approximately at 90° in relation to a hole punch axis in a translatory manner in a direction of the body axis, guiding a punch, which is integrated in a guiding bore of an internal high-pressure forming mold, along the hole punch axis, and hole-punching upon moving the punch in the guiding bore, wherein the punch is acted on during its movement by non-rotationally-symmetrical surfaces of the driving element, and wherein the hole-punching takes place from outside inward by way of advancing movement of the punch with respect to the hollow profile.

11. A method for creating a hole at an outer circumference of a hollow profile which is circumferentially closed and under an internal high pressure, comprising:

driving a driving element having a body axis which lies approximately at 90° in relation to a hole punch axis in a translatory manner in a direction of the body axis, guiding a punch, which is integrated in a guiding bore of an internal high-pressure forming mold, along the hole punch axis, and hole-punching upon moving the punch in the guiding bore, wherein the punch is acted on during its movement by non-rotationally-symmetrical surfaces of the driving element, and wherein, after its formation by the punch, a punched slug is pressed into the hole flush with a rim of the hole.

12. A method for creating a hole at an outer circumference of a hollow profile which is circumferentially closed and under an internal high pressure, comprising:

driving a driving element having a body axis which lies approximately at 90° in relation to a hole punch axis in at least one of a rotary manner and a translatory manner in a direction of the body axis, guiding a punch, which is integrated in a guiding bore of an internal high-pressure forming mold, along the hole punch axis, and hole-punching upon moving the punch in the guiding bore, wherein the hollow profile is cut into by the punch at a location of a slug to be created, thereby forming a predetermined breaking location, and wherein, after its formation by the punch, a punched slug is pressed into the hole flush with a rim of the hole.

13. A device for creating a hole at an outer circumference of a hollow profile which is circumferentially closed and under an internal high pressure, comprising:

a punch which is integrated in a forming mold such that it can be guided, and, before hole-punching, abuts against a location of the hole to be created, and a driving element for driving the punch, wherein a body axis of the driving element is arranged approximately at 90° in relation to a hole punch axis, and wherein the driving element is driven in a rotary manner and acts with a driving surface on a punch head arranged on a side of the punch facing away from a mold impression acting together with an internal high pressure driving the punch outward.

14. The device as claimed in claim 13, wherein the driving element is a shaft which has at least one non-rotationally-symmetrical surface forming the driving surface.

15. The device as claimed in claim 14, wherein the driving surface is formed by the contour of a cam, which is either formed from the shaft or joined onto the shaft.

16. The device as claimed in claim 13, wherein the driving element is arranged parallel to an upper side of a forming mold.

17. The device as claimed in claim 13, wherein the driving element is arranged parallel to an underside of a forming mold.

18. A device for creating a hole at an outer circumference of a hollow profile which is circumferentially closed and under an internal high pressure, comprising:

a punch which is integrated in a forming mold such that it can be guided, and, before hole-punching, abuts against a location of the hole to be created, and a driving element for driving the punch, wherein a body axis of the driving element is arranged approximately at 90° in relation to a hole punch axis, wherein the driving element is driven in a translatory manner in the axial direction and acts with a driving surface on a punch head arranged on a side of the punch facing away from a mold impression acting together with an internal high pressure driving the punch outward, wherein the driving element is a slide, which has at least one wedge surface, which forms the driving contour, and wherein the slide has at least one hollow, at least one flank of which forms the wedge surface.

19. The device as claimed in claim 18, wherein the driving element is arranged parallel to an upper side of a forming mold.

20. The device as claimed in claim 18, wherein the driving element is arranged parallel to an underside of a forming mold.

* * * * *